US006209983B1

(12) United States Patent
Osborne et al.

(10) Patent No.: US 6,209,983 B1
(45) Date of Patent: Apr. 3, 2001

(54) MULTI-RIDGE CAPPING SYSTEM FOR INKJET PRINTHEADS

(75) Inventors: William S. Osborne; Bret K. Taylor, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/906,274

(22) Filed: Aug. 5, 1997

Related U.S. Application Data

(63) Continuation of application No. 08/382,473, filed on Jan. 31, 1995, now Pat. No. 5,712,668, which is a continuation-in-part of application No. 08/218,391, filed on Mar. 25, 1994, now Pat. No. 5,617,124.

(51) Int. Cl.[7] ..... B41J 2/165
(52) U.S. Cl. ..... 347/32; 347/29
(58) Field of Search ..... 347/29–30, 32–33, 347/35

(56) References Cited

U.S. PATENT DOCUMENTS 5,426,456 * 6/1995 Kuelzer et al. ..... 347/30
5,444,474 * 8/1995 Ohtsubo et al. ..... 347/87
5,563,638 * 10/1996 Osborne ..... 347/32
5,587,729 * 12/1996 Lee et al. ..... 347/32
5,617,124 * 4/1997 Taylor et al. ..... 347/35

* cited by examiner

*Primary Examiner*—N. Le
*Assistant Examiner*—Thien Tran
(74) *Attorney, Agent, or Firm*—Flory L. Martin

(57) ABSTRACT

A rotary capping system services inkjet printheads in an inkjet printing mechanism. A rotary service station has a tumbler with a dual pivoting link that supports a cap platform. The cap platform is gimbal mounted to the link and spring-biased away from the tumbler. The platform has an extending arm that contacts the printhead carriage to align the cap and printhead. When the printhead is positioned for capping, rotation of the tumbler around an axis parallel to the printhead scanning direction brings the platform arm into contact with the carriage. Continued rotation of the tumbler pivots the link and the platform to sweep the cap through a non-linear, generally arcuate path into a capping position at the printhead. The illustrated cap has a multi-ridge lip for sealing over surface irregularities on the printhead nozzle face. A method of sealing inkjet printhead nozzles is also provided.

26 Claims, 12 Drawing Sheets

FIG. 7
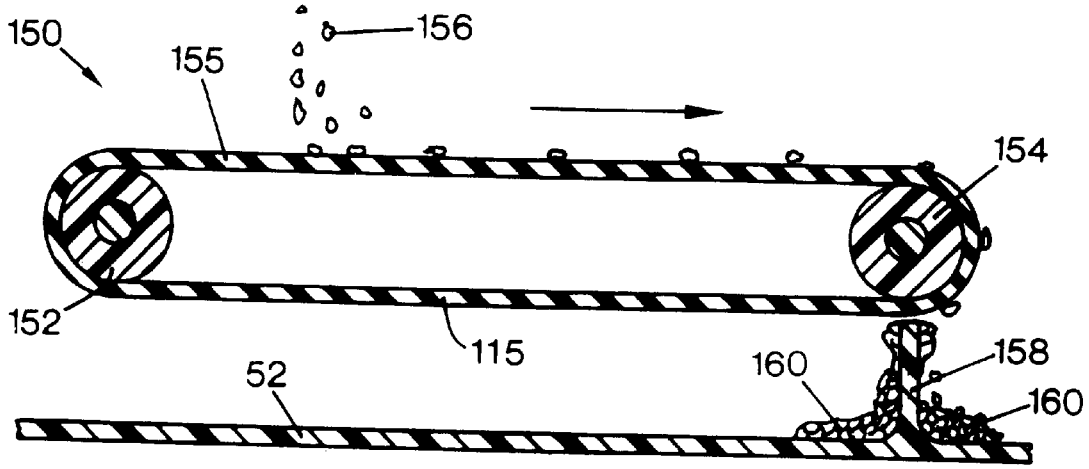
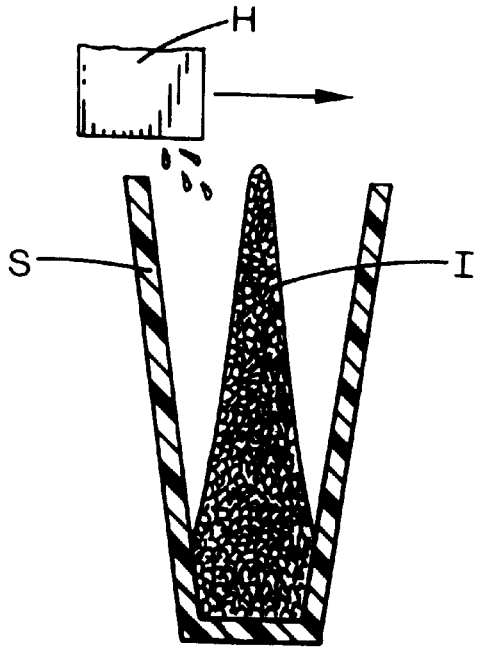
FIG. 8
PRIOR ART

FIG. 13A
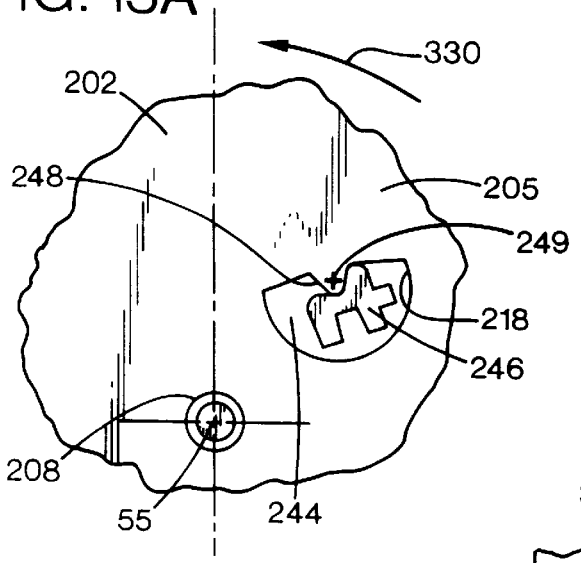
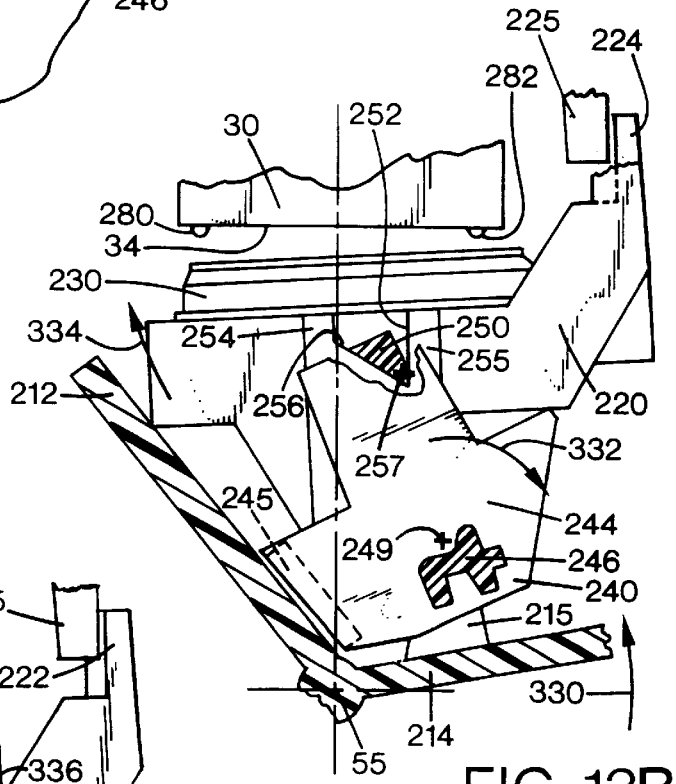
FIG. 13B
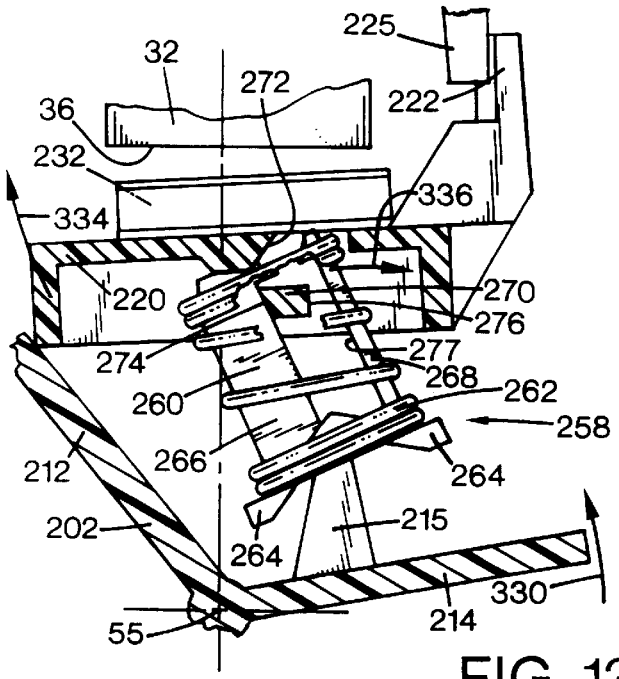
FIG. 13C

MULTI-RIDGE CAPPING SYSTEM FOR INKJET PRINTHEADS

CROSS REFERENCE TO RELATED APPLICATION(S)

This is a continuation of application Ser. No. 08/382,473 filed on Jan. 31, 1995, now U.S. Pat. No. 5,712,668, issued on Jan. 27, 1998, which is a continuation-in-part of application Ser. No. 08/218,391, filed Mar. 25, 1994, now U.S. Pat. No. 5,617,124, issued on Apr. 1, 1997.

FIELD OF THE INVENTION

The present invention relates generally to inkjet printing mechanisms, and more particularly to an improved capping system for storing inkjet printheads therein during periods of inactivity, including a new multi-ridge printhead cap, a new rotary printhead servicing apparatus, and a new printhead sealing method.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. To clean and protect the printhead, typically a service station is mounted within the printer chassis. For storage, or during non-printing periods, service stations usually include a capping system which humidically seals the printhead nozzles from contaminants and drying. Some caps are also designed to facilitate priming, such as by being connected to a pumping unit that draws a vacuum on the printhead.

During operation, clogs in the printhead are periodically cleared by firing a number of drops of ink through each of the nozzles in a process known as "spitting." Typically, the waste ink is collected in a stationary reservoir portion of the service station, which is often referred to as a "spittoon." After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solids content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves.

Partially or completely blocked nozzles can lead to either missing or misdirected drops on the print media, either of which degrades the print quality. Thus, spitting to clear the nozzles becomes even more important when using pigment based inks, because the higher solids content contributes to the clogging problem more than the earlier dye based inks. Unfortunately, while stationary spittoons were suitable for the earlier dye based inks, they suffer a variety of drawbacks when used with newly developed pigment based inks.

For example, FIG. 8, is a vertical sectional view of a conventional prior art spittoon S which has been receiving waste ink of the newer variety for a period of time. The rapidly solidifying waste ink has gradually accumulated into a stalagmite I. The ink stalagmite I may eventually grow to contact the printhead H, which could interfere with printhead movement, print quality, and/or contribute to clogging the nozzles. Indeed, ink deposits along the sides of the spittoon often grow into stalagmites which can meet one another to form a bridge blocking the entrance to the spittoon. To avoid this phenomenon, conventional spittoons must be wide, often over 8 mm in width to handle these new pigment based inks. This extra width increases the overall printer width, resulting in additional cost being added to the printer, both in material and shipping costs.

This stalagmite problem is particularly acute for a polymer or a wax based ink, such as an ink based on carnauba wax, or a polyamide. In the past, inkjet printers using polyamide based inks have replaced the conventional spittoon of FIG. 8 with a sheet of flat plastic. The nozzles are periodically cleared by "spitting" the hot wax ink onto the plastic sheet. At regular intervals, an operator must remove this plastic sheet from the printer, flex the sheet over a trash can to remove the waste ink, and then replace the cleaned sheet in the printer. This cleaning step is particularly inconvenient for operators to perform on a regular basis, and is not suitable for the new pigment ink. In comparison to the wax or polymer based inks, these new inks leave a dirty, sticky residue, due to the high amount of solids used to improve the contrast and quality of the printed images. Thus, operator intervention to regularly clean a pigmented ink spittoon could lead to costly staining of clothing, carpeting, upholstery and the like.

In addition to increasing the solids content, mutually precipitating inks have been developed to enhance color contrast. For example, one type of color ink causes black ink to precipitate out of solution. This precipitation instantly fixes the black solids to the page, which prevents bleeding of the black solids into the color regions of the printed image. Unfortunately, if the mutually precipitating color and black inks are mixed together in a conventional spittoon, they do not flow toward a drain or absorbent material. Instead, once mixed, the black and color inks instantly coagulate into a gel, with some residual liquid being formed.

Thus, the mixed black and color inks have the drawbacks of hot-melt inks, which have an instant solid build-up, and the aqueous inks, which tend to run and "wick" (flow through capillary action) into undesirable locations. To resolve the mixing problem, two conventional stationary spittoons are required, one for the black ink and one for the color inks. As mentioned above, these conventional spittoons must be wide to avoid clogging from stalagmites growing inward from the spittoon sides. Moreover, using two spittoons further increases the overall width of the printer, which undesirably adds to the overall size of the inkjet printer, as well as its weight and material cost to build.

To maintain a high print quality in the hardcopy output, pens containing the new pigment based inks require new capping strategies. The pigment based inks have posed new challenges for efficiently capping the printheads. To maintain the desired ink characteristics, the area around the printhead nozzles must be kept clean and moist to prevent drying or decomposition of the ink during periods of printer inactivity. These principles are equally applicable to pens containing dye based inks.

In the past, a variety of different systems have been used to seal an inkjet printhead during periods of printer inactivity. These capping systems may be divided into three general categories based upon the direction of movement to engage the printheads, specifically, (1) linear caps, (2) vertical caps, and (3) rotary caps. The first group, linear caps, unfortunately require excessive carriage overtravel well beyond the print zone to seal the printheads. The mechanisms employed by these linear capping systems include an in-line four bar linkage mechanism, a ramp mounted sled, a four bar linkage including a spring mechanism, and combination ramp and spring mechanisms. Typically, these linear caps are pushed by the printhead in a direction parallel to the printhead scanning axis, and during this lateral motion, the caps are raised to seal the printhead nozzles.

Second, the vertical capping group of mechanisms move the caps upwardly to engage the printheads. One system uses a vertical rack and pinion mechanism, driven by a motor to move the caps upward to seal the printheads. Another vertical system uses a spring loaded vertical cam drive mechanism to cap the printheads.

The third capping system involves rotating the caps into position. One known rotary capping system rotates the caps about an axis which is perpendicular to the scanning axis of the printhead, and then cams the cap upward to engage the printhead. Another rotary system rotates a spring-biased lever to pivot the cap into a sealing position. This particular system gimbal-mounts the cap to the lever for limited angular tilting with respect to the printhead.

Unfortunately, each of these earlier capping systems has a variety of disadvantages. For example, many of them require extra carriage travel beyond the width required to mount the caps. This extra carriage travel results in a wider product with a large "footprint" (the work surface area occupied by the product). Some of these capping systems also have difficulty in sealing substantially irregular or nonplanar surfaces, such as those encountered when ink residue or other debris has accumulated on the printhead. These earlier systems also have difficulty in maintaining critical capping tolerances. Additionally, many of these earlier capping systems are sensitive to ink leakage from the pens, and accumulations of ink aerosol within the capping mechanism. The sticky aerosol and/or ink leakage build up may impede motion of critical components, leading to ineffective capping. Moreover, ink leakage from the capped pens often blocked or clogged vent ports within these earlier capping mechanisms.

SUMMARY OF THE INVENTION

According to one aspect of the invention, a service station is provided for servicing an inkjet printhead of an inkjet printing mechanism, with the printhead having nozzles that selectively eject ink therethrough. The service station includes a tumbler that is rotatable around a first axis, and a platform pivoted to the tumbler for movement to a capping position. A printhead cap is supported by the platform to surround and seal the printhead nozzles when in the capping position.

In an illustrated embodiment, the platform has an arm portion that engages a printhead structure when the tumbler is rotated around the first axis. A dual pivot structure is used to cradle the platform within the tumbler. A biasing member urges the platform away from the tumbler. The platform cooperates with a resilient vent stopper member to define a non-clogging vent passageway which avoids depriming the inkjet pen during capping, as well as during any environmental changes in temperature, barometric pressure, etc., while capped.

According to another aspect of the present invention, a method is provided of sealing inkjet printhead nozzles of an inkjet printing mechanism. The method includes the step of supporting a printhead cap with a platform. The cap is configured to surround and seal the printhead nozzles when in a capping position. In a revolving step, the platform is revolved around a first axis. During the revolving step, a portion of the platform is engaged with a printhead structure. In a rocking step, the engaged platform is rocked into the capping position.

According to a further aspect of the present invention, a method is provided of sealing inkjet printhead nozzles of an inkjet printing mechanism which includes the step of providing a printhead cap configured to surround and seal the printhead nozzles when in a capping position. In a cradling step, the cap is cradled within a tumbler. In a traversing step, the cap is traversed along a non-linear path into the capping position by rotating the tumbler.

According to one aspect of the invention, a service station is provided for servicing an inkjet printhead of an inkjet printing mechanism, where the printhead has a face plate defining a group of ink ejecting nozzles extending therethrough. The service station has a platform moveable into a capping position. A printhead cap is supported by the platform. The cap has a sealing lip that surrounds the nozzles and engages the face plate when in the capping position. The lip has at least a portion with adjacent plural contact regions capable of sealing over surface irregularities on the face plate.

An overall object of the present invention is to provide an inkjet printing mechanism which prints sharp vivid images, and which preferably does so using a fast drying pigment based ink.

Another object of the present invention is to provide a service station for an inkjet printing mechanism which maintains pen health and occupies a relatively small physical space to provide a more compact product.

A further object of the present invention is to provide a method of sealing an inkjet printhead mounted in a printing mechanism during periods of inactivity to maintain ink composition integrity.

BRIEF DESCRIPTION OF THE DRAWINGS

FIG. 7 is a side elevational view of a third embodiment of a self-cleaning service station of the present invention.

FIG. 8 is a side elevational view of a conventional spittoon portion of a prior art service station.

FIGS. 13A–13C and 14A–14C are enlarged side elevational sectional views showing the relative positions of the system components of FIGS. 9–12, with FIGS. 14A, 14B, and 14C being views taken along the respective lines A—A, B—B, and C—C of FIG. 9 shown capping, and FIGS. 13A–13C showing prior to capping.

DETAILED DESCRIPTION OF THE PREFERRED EMBODIMENTS

Figure 1:
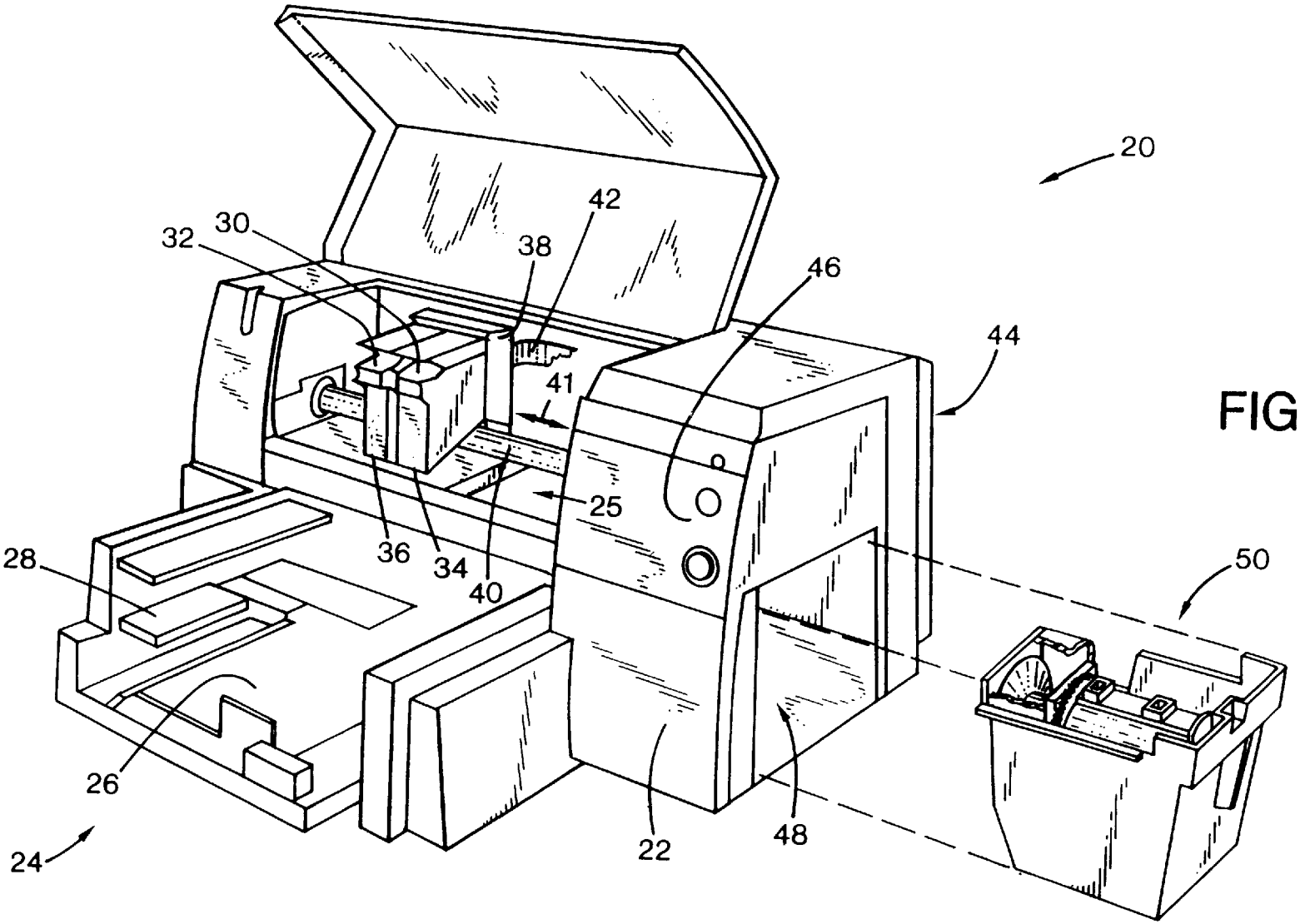
FIG. 1 is a perspective view of one form of an inkjet printing mechanism of the present invention incorporating a first embodiment of a self-cleaning service station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 and a print medium handling system 24 for supplying sheets of print media to the printer 20. The print media may be any type of suitable sheet material, such as paper, card-stock, transparencies, mylar, foils, and the like, but for convenience, the illustrated embodiment is described using paper as the print medium. The print medium handling system 24 moves the print media into a print zone 25 from a feed tray 26 to an output tray 28, for instance using a series of conventional motor-driven rollers (not shown).

In the print zone 25, the media sheets receive ink from an inkjet cartridge, such as a black ink cartridge 30 and/or a color ink cartridge 32. The cartridges 30, 32 are also referred to as "pens" by those in the art. The illustrated color pen 32 is a tri-color pen, although in some embodiments, a group of discrete monochrome pens may be used, or a single monochrome black pen 30 may be used. While the color pen 32 may contain a pigment based ink, for the purposes of illustration, pen 32 is described as containing three dye based ink colors, such as cyan, yellow and magenta. The black ink pen 30 is illustrated herein as containing a pigment based ink. It is apparent that other types of inks may also be used in pens 30, 32, such as paraffin based inks, as well as hybrid or composite inks having both dye and pigment characteristics.

The illustrated cartridges or pens 30, 32 each include reservoirs for storing a supply of ink therein, although other ink supply storage arrangements, such as those having reservoirs (not shown) mounted along the chassis may also be used. The cartridges 30, 32 have printheads 34, 36 respectively. Each printhead 34, 36 has bottom surface comprising an orifice plate with a plurality of nozzles formed therethrough (see FIG. 18) in a manner well known to those skilled in the art. The illustrated printheads 34, 36 are thermal inkjet printheads, although other types of printheads may be used, such as piezoelectric printheads. The printheads 34, 36 typically include a plurality of resistors which are associated with the nozzles. Upon energizing a selected resistor, a bubble of gas is formed ejecting a droplet of ink from the nozzle and onto a sheet of paper in the print zone 25 under the nozzle.

The cartridges or pens 30. 32 are transported by a carriage 38 which may be driven by a conventional drive belt/pulley and motor arrangement (not shown) along a guide rod 40. The guide rod 40 defines a scanning direction or scanning axis 41 along which the pens 30, 32 traverse over the print zone 25. The pens 30, 32 selectively deposit one or more ink droplets on a print media page located in the print zone 25 in accordance with instructions received via a conductor strip 42 from a printer controller, such as a microprocessor which may be located within chassis 22 at the area indicated generally by arrow 44. The controller 44 may receive an instruction signal from a host device, which is typically a computer, such as a personal computer. The printhead carriage motor and the paper handling system drive motor operate in response to the printer controller 44, which may operate in a manner well known to those skilled in the art. The printer controller may also operate in response to user inputs provided through a key pad 46. A monitor coupled to the host computer may be used to display visual information to an operator, such as the printer status or a particular program being run on the computer. Personal computers, their input devices, such as a keyboard and/or a mouse device, and monitors are all well known to those skilled in the art.

Figure 2:
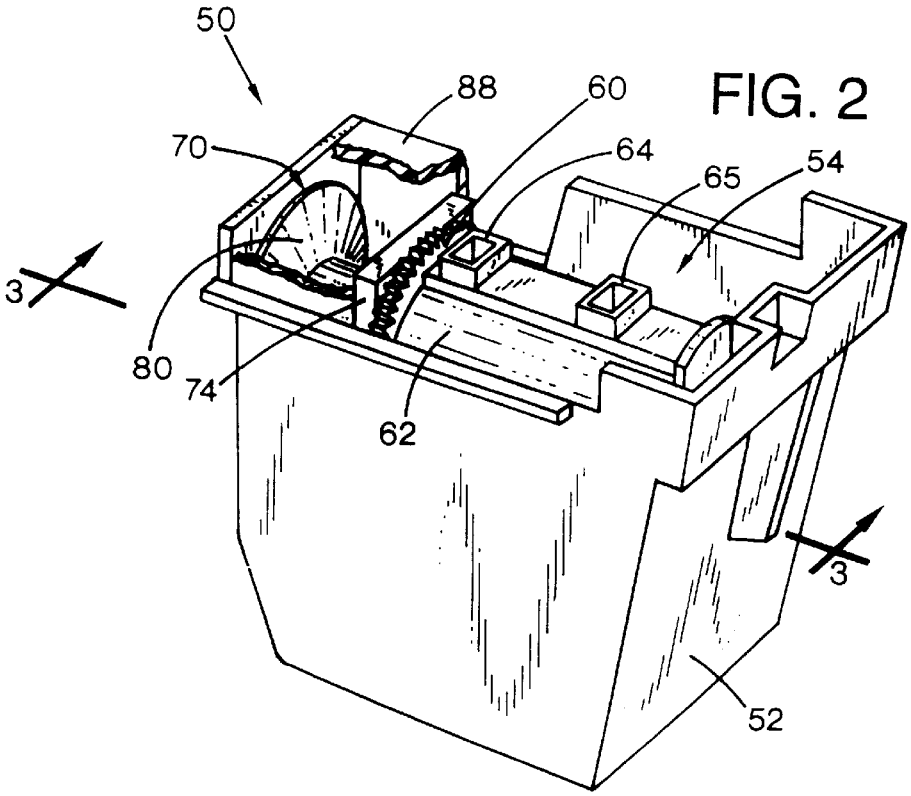
FIG. 2 is a perspective view of the self-cleaning service station of FIG. 1.
Figure 3:
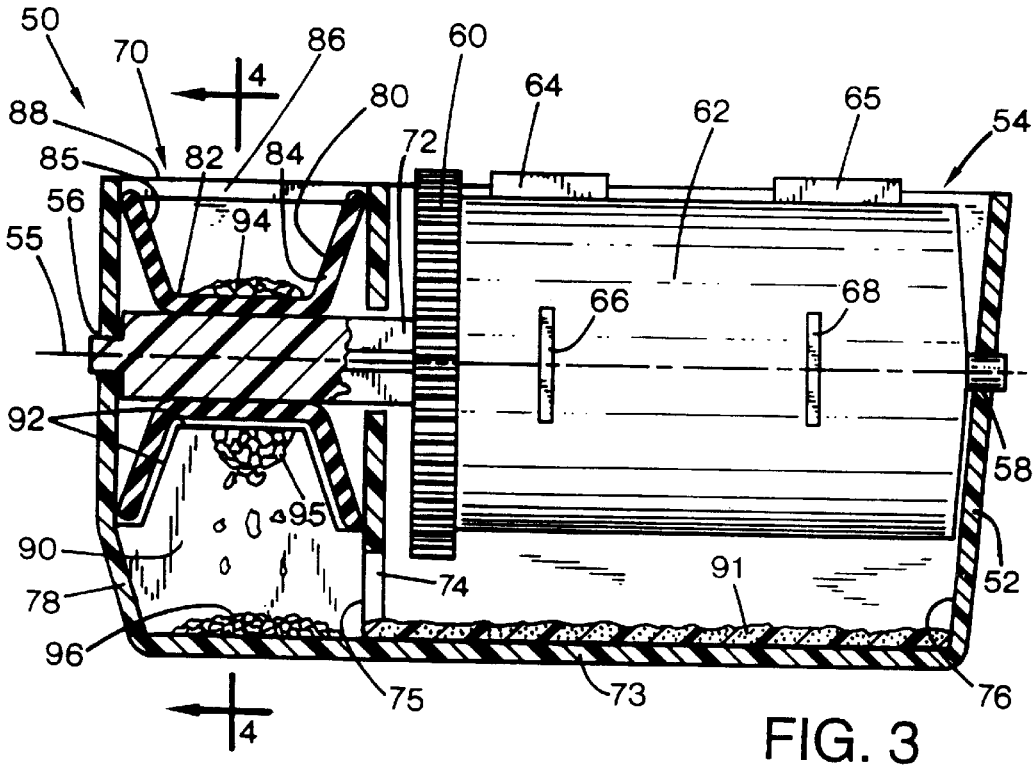
FIG. 3 is a front vertical elevational view taken along lines 3—3 of FIG. 2.
Figure 4:
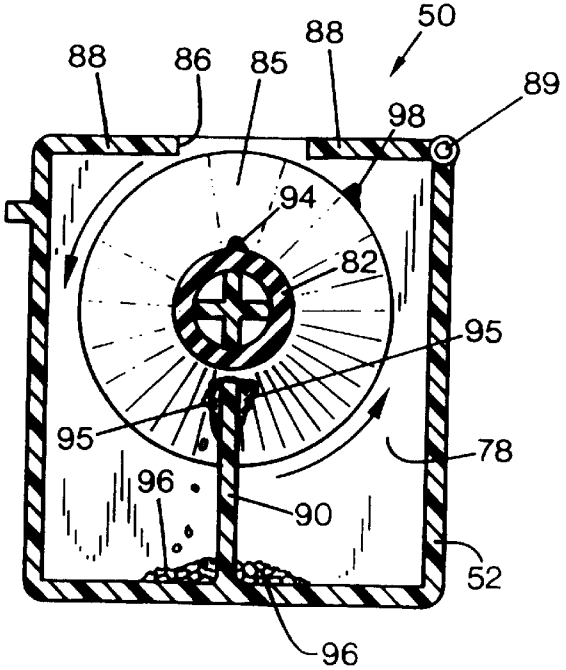
FIG. 4 is a side elevational view taken along lines 4—4 of FIG. 3.
Figure 9:
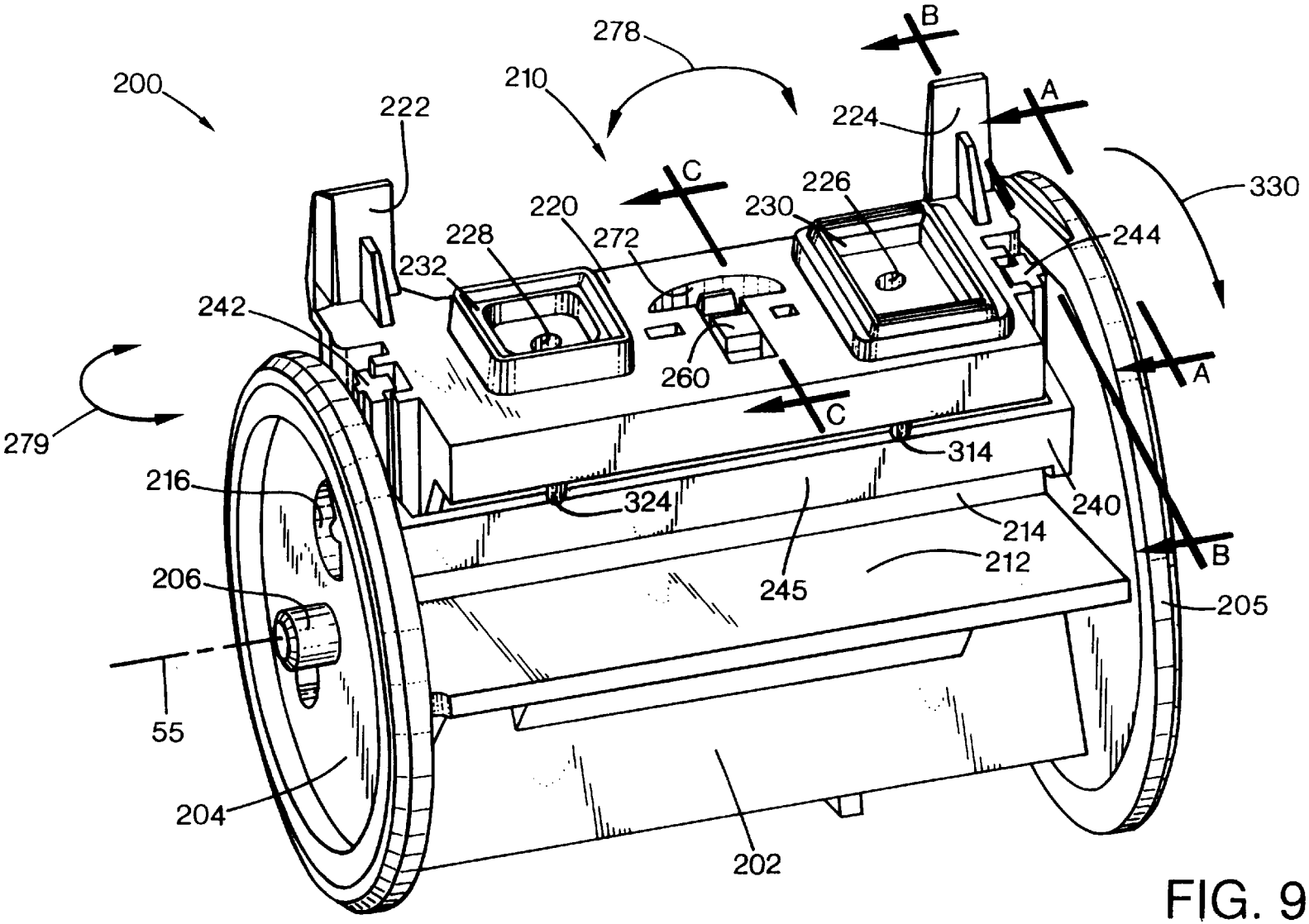
FIG. 9 is a perspective view of an alternate embodiment of a rotary service station capping system of the present invention, shown in a capping position but removed from the service station frame.

Referring also to FIGS. 2–4, the printer chassis 22 has a chamber 48, configured to receive a service station 50, located at one end of the travel path of carriage 38. Preferably, the service station 50 is constructed as a replaceable modular device capable of being unitarily inserted into the printer 20, to enhance ease of initial assembly, as well as maintenance and repair in the field. The illustrated service station 50 has a frame 52 which may be slidably received within chamber 48 the printer chassis 22. However, it is apparent that the service station 50 may also be constructed with the station frame 52 integrally formed within the chassis 22.

The service station 50 has a tumbler portion 54 mounted to frame 52 for rotation about a first axis or tumbler axis 55 with bearing surfaces 56, 58. The tumbler axis 55 is substantially parallel to the printhead scanning axis 41. The tumbler 54 may be driven by motor and gear or belt assembly (not shown), or through a separate motor (not shown) via a gear 60. The tumbler 54 includes a main body 62 upon which may be mounted conventional inkjet pen caps, such as a color ink cap 64 and a black cap 65. The body 62 also supports color and black ink wipers 66 and 68 for wiping the respective color and black printheads 36, 34. Other functions may also be provided on the main body 62, such as primers and the like, which are known to those skilled in the art. It is apparent that other arrangements may be used to index the pen capping, wiping, etc. functions rather than the tumbler main body 62. For example gears or linkages (not shown) known to those skilled in the art may be used for selectively engaging the service station equipment 64, 65 and 66, 68 with the respective printheads 36, 34. However, the tumbler concept illustrated in FIGS. 1–4 is preferred because of its ease of implementation and adaptability for modular use.

Self-Cleaning Service Station—First Embodiment

FIGS. 1–4 illustrate the first embodiment of the self-cleaning service station 50 as having a rotating annular trough or "ferris wheel" spittoon 70. The spittoon 70 receives ink which is spit from the black ink and color pens 30, 32 when they are positioned above the spittoon. The spittoon 70 is driven by gear 60 via a roller, spindle or axle portion 72, which extends from the main body 62. The frame structure 52 has a bottom wall 73 and an intermediate wall 74. The wall 74 separates the service station 50 into a spittoon chamber 75 and a main servicing chamber 76. As shown in FIG. 3, the spittoon chamber 75 is located between wall 74 and an outer wall 78 of the frame 52.

The ferris wheel spittoon 70 has a moveable platform provided by an annular trough or "ferris wheel" 80. The wheel 80 has an annular bottom portion 82 and two side walls 84, 85, and is mounted to the axle 72 for rotation about the tumbler axis 55. The wheel 80 receives ink purged from the printheads 34 and 36 through an opening 86. The opening 86 is defined by an upper wall or lid 88, which may be a portion of, or pivoted at a hinge 89 to, the frame 52. Preferably, the wheel 80 is of an elastomeric or other resilient and flexible material, such as neoprene. The use of an elastomeric material is preferred to facilitate sealing the area between the wheel side walls 84, 86 and the frame walls 74 and 78, respectively. However, it is apparent that other types of material may also be used for wheel 80, such as various plastics which are flexible and resilient to provide a positive seal between the wheel 80 and walls of frame 52.

The spittoon 70 also has a scraper portion 90 for removing purged ink from the ferris wheel 80, as shown in FIG. 3. Adjacent the scraper 90, the main servicing chamber 76 may be lined with a liquid absorbent diaper 91, which may be of a felt, pressboard, sponge or other material. The diaper 91 absorbs liquids spit from the pens 30, 32. When both black and color inks are deposited in the spittoon 70, once mixed, these inks instantly coagulate into a gel, with some residual liquid being formed. This residual liquid may also be absorbed by the diaper 91.

In the illustrated embodiment, the scraper 90 is of a substantially rigid plastic material. The scraper 90 may be molded unitarily with the remaining portion of frame 52 for convenience, although it is apparent that the scraper 90 may be separately assembled into frame 52. The scraper portion 90 preferably has a scraping surface 92 conformed to roughly approximate the cross-sectional shape of the wheel 80, as shown in FIG. 3.

In operation, referring to FIGS. 3–4, recently spit ink 94 is collected along the wheel bottom surface 82. The tumbler 54 is rotated via a gear assembly (not shown) in contact with gear 60 until the majority of the discharged ink 94 is removed from roller 80 by scraper 90. An accumulation of recently removed ink 95 may accumulate adjacent the upper edge 92 of the scraper 90. Eventually, this accumulated ink 94 will dry and fall from the scraper to form piles of dried ink solids 96 at the bottom of the spittoon chamber 75. Ink may also accumulate along the rim surface of the ferris wheel side walls 84, 85, such as ink accumulation 98 shown in FIG. 4. Advantageously, by selecting a relatively close spacing between the lid 88 and the walls 84, 85, the lid 88 scrapes the ink solids 98 from the wheel rims to prevent the solids 98 from touching the printheads 34, 36. As mentioned in the background portion, if left unattended, such ink residue 98 could contact the nozzle plate, potentially damaging or clogging the orifices of the printheads 34, 36.

Self-Cleaning Service Station—Second Embodiment

Figure 6:
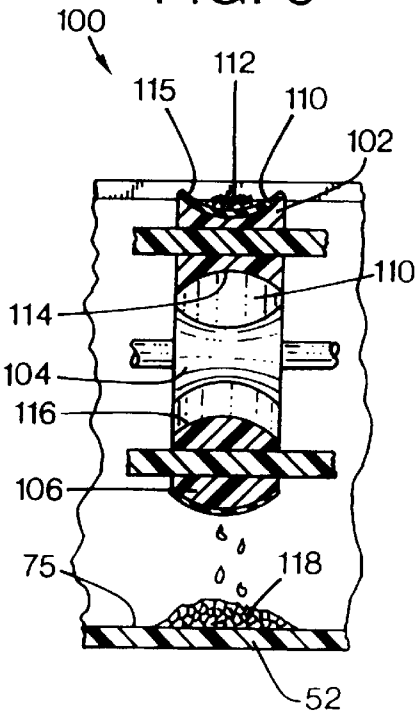
FIG. 6 is a front elevational view taken along lines 6—6 of FIG. 5.
Figure 5:
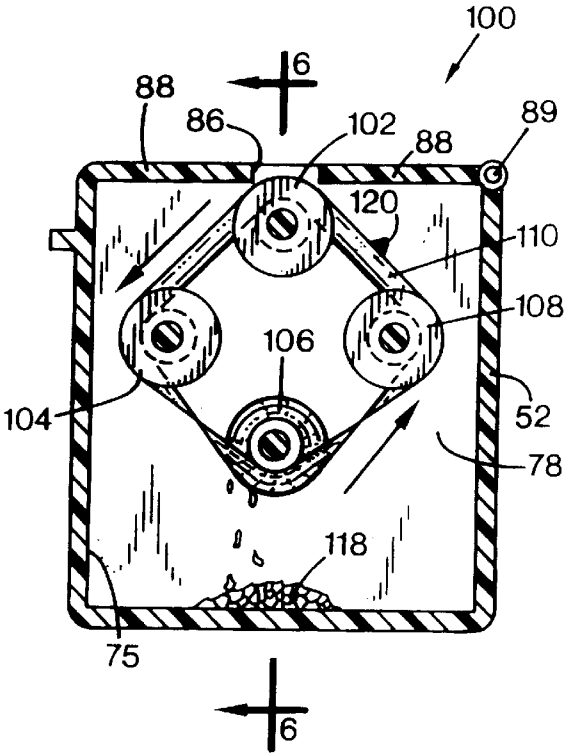
FIG. 5 is a side elevational view of a second embodiment of a self-cleaning service station of the present invention.

FIGS. 5 and 6 illustrate a second alternate embodiment of an inkjet spittoon 100 constructed in accordance with the present invention, which may be substituted for the ferris wheel spittoon 70 of FIGS. 1–4. The spittoon 100 comprises a multiroller spittoon having two or more rollers, here, having four rollers 102, 104, 106 and 108. One of the rollers 102–108 may be driven by gear 60 and the remaining rollers may be mounted between walls 74 and 78 for free pivoting. The rollers 102–108 support an a moving platform comprising an endless belt 110, which may be constructed of an elastomer, polymer, plastic, fabric, or other flexible material.

In the spittoon 100, the mechanism for removing recently spit ink 112 from belt 110 comprises an ink removal device formed by the contours of rollers 102 and 106, rather than through the use of a scraper 90. In the illustrated embodiments, the roller 102 is positioned under opening 86 in the lid 88. The roller 102 has a concave surface 114 which forms a trough 115 in belt 110 for receiving the ink 112. To expel the ink 112 from belt 110, the lower roller 106 has a convex surface 116 which flexes the belt 110 outwardly to dump the spent ink solids 112 into a refuse ink pile 118 along the lower surface of the spittoon chamber 75. Rollers 104 and 108 may be cylindrical or have configurations which are either concave or convex, but as illustrated, roller 104 is concave and roller 108 is convex. Furthermore, it is apparent that a scraper mechanism, such as scraper 90, may also be used in conjunction with the contoured rollers 102, 106 to remove ink deposits from the belt 110. The rim of roller 102, thickness and width of belt 110, and the relative location of lid 88 to the edges of belt 110 may be selected to remove ink accumulations 120 from the belt edges, as described above with respect to FIG. 4 for the rim accumulation 98.

Self-Cleaning Service Station—Third Embodiment

A third embodiment of a self-cleaning spittoon 150 is shown in cross-section in FIG. 7. The spittoon 150 may include two or more rollers, such as roller 152 and 154 which are coupled together by an endless belt 155. Preferably, roller 152 may be coupled to the tumbler portion 54 to be driven by gear 60. In the illustrated embodiment, roller 152 is positioned below the frame lid opening (not shown) in the frame lid 88 to receive the ink 156 from printheads 34, 36. The ink 156 travels along the upper surface of belt 155, and around roller 154 where it encounters a scraper 158, and is scraped off as ink solids 160. Alternatively, the illustrated cylindrical rollers 152 and 152 may be replaced with concave and convex rollers, such as roller 102 and 106, respectively of FIGS. 5 and 6. In such an embodiment, the scraper 160 may be used in conjunction with roller 154 having a convex shape, or the scraper 160 may be omitted in such a contoured roller embodiment. The belt 155 may be as described above with respect to belt 110 regarding flexing.

One advantage of the spittoon embodiment 150 is that it receives ink in one portion of the printer adjacent roller 152, and expels the dried solids in a remote location adjacent roller 154. While the belt 155 is illustrated as being a substantially flat belt, it is apparent that it may be flexible to conform to the contours of rollers as described above with respect to FIGS. 5–6, or it may have side walls similar to walls 84 and 86 (FIG. 3).

Method of Purging an Inkjet Pen

According to another aspect of the illustrated embodiment, a method is also provided for cleaning an inkjet pen, such as pen 30 or 32, when mounted for use in an inkjet printer, such as printer 20. The method includes the steps of positioning the pen 30 or 32 over a moveable platform surface of the service station 70. This moveable platform may be provided by the ferris wheel 80, or belts 110 or 155. A portion of the ink is purged from the pen 30 or 32 onto the platform. The platform is then moved to a discharge location, illustrated here with the platforms being driven by rotating gear 60 or the at least one of the rollers 102–108 and 152–154. The discharge location is illustrated as adjacent scraper 90 (FIGS. 3–4), adjacent roller 106 (FIGS. 5–6), and adjacent roller 154 and scraper 158, if used (FIG. 7).

In a discharging step, the purged waste ink is discharged from the platform surface at the discharge location. As shown in FIGS. 3–4, the discharging is illustrated by scraper 90 scraping ink off of the ferris wheel 80. In FIGS. 5–6, discharging is accomplished by flexing the belt 110 using the convex contour 116 of roller 106. In FIG. 7, the scraper 158 provides the discharge mechanism, in addition to, or as an alternative to a convex profile for roller 154. That is, the contoured roller concept may be combined with the scraper concept (not shown) by forming the scraper upper surface (item 92 in FIG. 3) with a concave contour to compliment the convex contour of roller 106, for instance.

Advantages of the Self-Cleaning Service Station

Thus, a variety of advantages are achieved using the movable platform spittoon of the present invention, for example in the various embodiments as illustrated in FIGS. 1–7. For instance, ink no longer accumulates into a stalagmite I as shown in FIG. 8 for the earlier conventional spittoon S. Instead, the waste ink is transported from a receiving location to a discharge location where it is broken off in small pieces 96, 118, 160. During periodic servicing of the printer 20, these waste ink solids 96, 118, 160 may be easily removed, and they are more compact for disposal than the large stalagmites I encountered in the prior art (FIG. 8). Thus, the packing density of a pile of short stalagmites formed as shown in FIGS. 3–7 is much less than that for the large stalagmite I shown in FIG. 8.

Furthermore, the use of a moveable platform spittoon allows for the accumulation of a greater number of ink solids than achieved with the stationary spittoon S of FIG. 8. As a result, the printer 20 may be operated for longer periods of time between servicing to remove accumulated ink solids. Additionally, accumulation of the ink solids 95 will not inhibit printhead performance as would be the case for high ink solids using the earlier FIG. 8 stationary spittoon S.

Moreover, the illustrated spittoons of FIGS. 1–7 may have a very narrow width, e.g. narrow in the axial direction parallel with the tumbler axis 55. Indeed, the width of the ferris wheel 80, or the belt 110, 155 need only be as wide as the precision within which the ink may be spit into them, for instance, on the order of 2 mm, as opposed to 8 mm for spittoon S of FIG. 8. Thus, a narrower service station may be achieved, which reduces the overall size of printer 20 to reduce material costs, shipping and packing costs, and to provide a more compact printer 20 for the consumer.

The use of an elastomeric or other resilient material for the ferris wheel 80 of FIGS. 1–4 provides additional advantages. For example, the aqueous residue from the expelled ink 94 tends to run downwardly under the force of gravity, and to wick along comers and edges of the spittoon chamber 75. The elastomeric rims 84 and 86 of wheel 80 advantageously provide a liquid seal against walls 74 and 78, respectively. Even if liquid is lifted from the bottom portion of the chamber 75 by the rims 84 and 85 upwardly toward the lid 88, the rim seals will prevent this liquid from reaching the remaining service station equipment of the main body 62. That is, the rim 84 seals the opening in wall 74 through which the shaft 72 passes. Advantageously, the caps 64 and 65, the wipers 66 and 68, and any other service station component mounted on the main body 62 are kept clean to maintain print quality.

Ink aerosol generation is another problem that is addressed by the ferris wheel spittoon system described herein. Spit ink droplets and particles of ink impact the ferris wheel and stick to it, rather than losing velocity and being carried to, and deposited on, sensitive portions of the printer. These captured satellites are then unable to damage printhead components through friction and corrosion, nor are they available to fog any optical encoder components and cause loss of carriage position information. Eliminating a sizable portion of the aerosol also decreases soiling of an operator's fingers, clothing or other nearby objects.

Rotary Capping System

Referring to FIGS. 9–12, an alternate embodiment of a rotary service station 200 constructed in accordance with the present invention is illustrated. The rotary service station 200 includes a tumbler body portion 202 which terminates at opposing axial ends with two wheel portions or rims 204 and 205. The tumbler body 202 may be mounted pivotally at hubs 206 and 208 (also see FIG. 12) within the service station frame 52 by bearing assemblies, such as bearing 58 shown in FIG. 3, in place of tumbler 62. In the illustrated embodiment, the hub 208 may engage the spindle portion 72 which extends through the ferris wheel 80. Alternatively, the service station wall 74 may be equipped with a bearing member similar to bearings 56 or 58, to receive hub 206, with the spindle 72 then engaging hub 206 for providing rotation about the tumbler axis 55. In either case, the outer periphery of the tumbler rim 204 preferably has gear teeth formed thereon to function as the drive gear 60, but for clarity, the gear teeth have been omitted from FIGS. 9 and 10. Alternatively, it is apparent that the rotary service station 200 may also be used with a conventional spittoon comprising one, two or more fixed spittoon chambers instead of the ferris wheel service station 80 shown in FIGS. 1–4.

Figure 10:
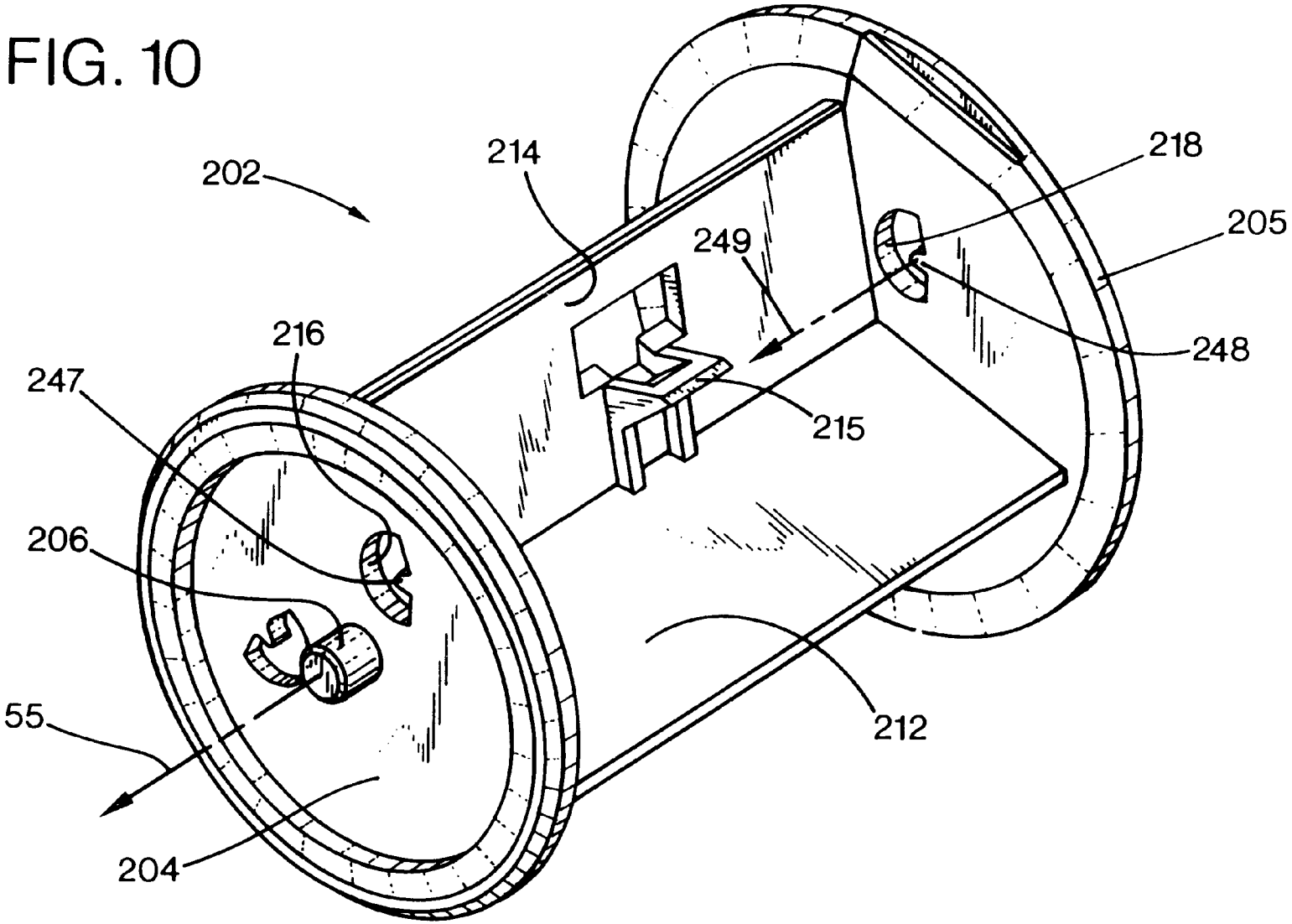
FIG. 10 is a perspective view of a tumbler portion of the system of FIG. 9.

The rotary station 200 includes a printhead capping system 210, constructed in accordance with the present invention, which includes the tumbler body 202. FIG. 10 shows the tumbler body 202 as having a rest wall 212, and a capping or stop wall 214. A rocker pivot post 215 extends upwardly from the stop wall 214. The tumbler rims 204 and 205 each define half-moon shaped recesses 216 and 218, respectively. The capping system 210 also has a cap support platform or sled 220, shown in detail in FIG. 11. The sled 220 has two extending alignment or contact arms 222 and 224, which maybe configured to engage a printhead structure, such as one of the pens 30, 32 or the printhead carriage 38, to facilitate capping, as described further below. In the illustrated embodiment, the arms 222, 224 are located for cooperative adjacency to engage a printhead structure comprising a downwardly extending alignment member 225 of carriage 38 during a selected portion of the tumbler rotation.

The sled 220 also defines two cap vent or drain holes 226 and 228. The capping assembly 210 has black and color ink printhead sealing caps 230 and 232 supported by sled 220, which surround the respective vent holes 226 and 228. The caps 230, 232 may be joined to the sled 220 by any conventional manner, such as by bonding with adhesives, sonic welding, or more preferably by oncert molding techniques. In the illustrated embodiment, the caps 230, 232 may be of a non-abrasive resilient material, such as an elastomer or plastic, a nitrile rubber or other rubber-like material, but more preferably, caps 230, 232 are of an ethylene polypropylene diene monomer (EPDM), or other comparable material known in the art. In the illustrated embodiment, the black ink cap 230 seals the black pen 30, which contains a pigment based ink, and the color cap 232 seals the color pen 32, which contains three dye based colored inks, such as cyan, magenta, and yellow.

Figure 14A:
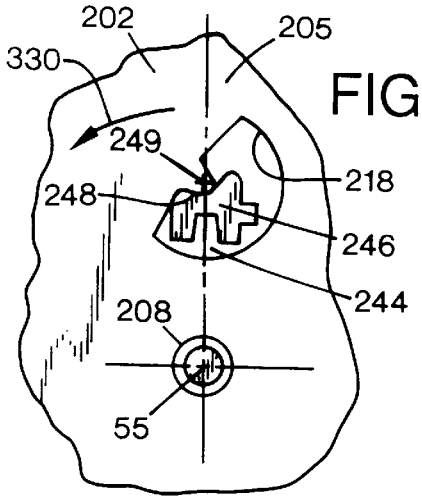
Figure 14B:
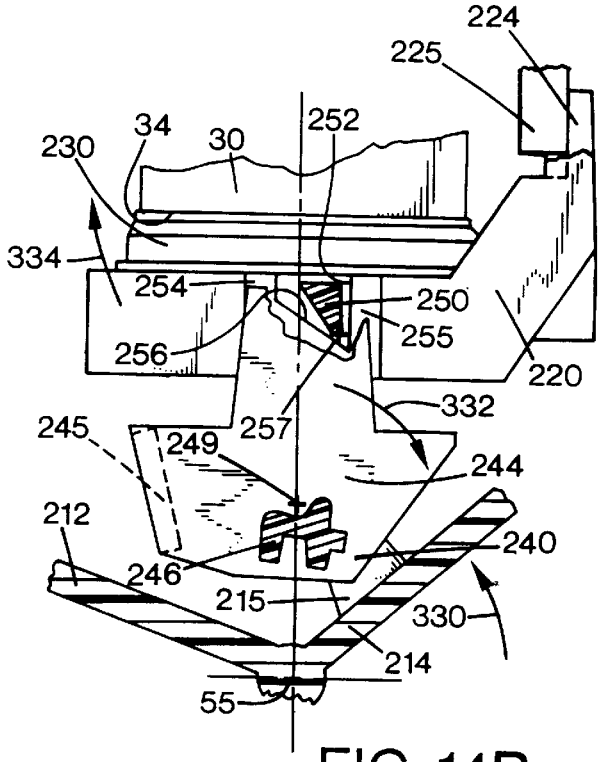
Figure 14C:
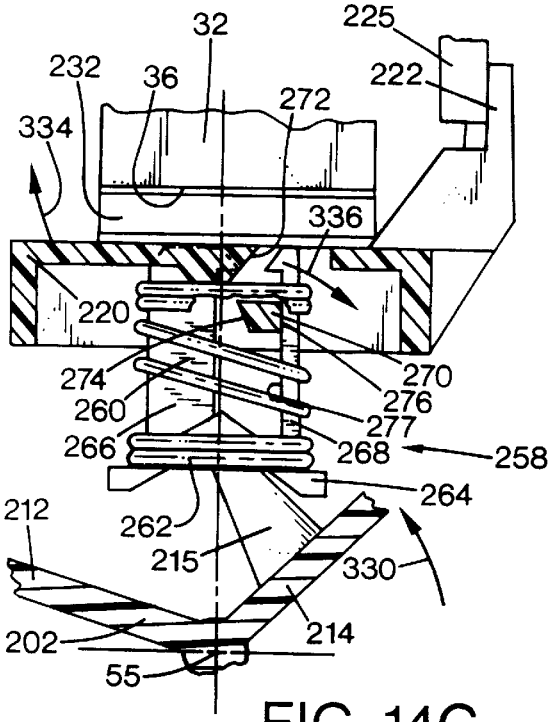

Referring also to FIGS. 13A through 16, one method of coupling the sled 220 to the tumbler body 202 is illustrated as using a link or yoke member 240 (for simplicity, the yoke 240 has been omitted from the views in FIGS. 13C and 14C). The yoke 240 is a dual pivot structure, having two upright ear members 242 and 244 joined together by a bridge member 245. Each ear 242, 244 has a lower rim pivot member which extends through the respective half-moon shaped slots 216, 218 of tumbler rims 204, 205, such as the rim pivot member 246 which extends through slot 218 in the tumbler rim 205. The half-moon shaped slots 216, 218, each define pivot shoulders 247, 248. The rim pivot members 246 engage and toggle about the pivot shoulders 248 during operation (compare FIG. 13A with FIG. 14A), for pivotal motion around a second axis 249, which is substantially parallel to the tumbler rotational axis 55. A comparison of FIGS. 13B and 14B shows the toggling action of the yoke 240 around axis 249 as the tumbler body 202 is rotated while sled 220 is held by the engagement of arms 222, 224 with the carriage locator 225. With respect to FIG. 13B, rotation of the sled 220 in a clockwise direction is limited by a triangular projecting portion of ears 242, 244 which engages an under surface of sled 220.

The second portion of the dual pivot structure of yoke 240 is provided by two wedge-shaped pivot hooks along the upper inner surface of ears 242, 244, such as pivot hook 250 on ear 244 (see FIGS. 13B and 14B). Each pivot hook 250 is captured by and received within a pocket 252 of sled 220. Each pocket 252 is defined by a pair of rails 254, 255 and a lower rest surface 256. As shown in FIG. 13B, the pivot hook 250 rests against the lower surface 256 when the capping assembly 210 is at rest. When in a capping position, the hook 250 rests against a loaded or capping pocket surface provided by rail 255. Thus, the sled 220 pivots with respect to the yoke 240 around a third axis 257. As the yoke 240 toggles between the rest and fully capped positions, the pivoting action of yoke 240 with respect to the tumbler body 202 around axis 249 is controlled by the lower rim pivot 246, whereas the pivoting of the sled 220 with respect to yoke 240 around axis 257 is provided by the wedge-shaped hooks 250.

As shown in FIGS. 13C and 14C, to bias the sled 220 in a rest position relative to the tumbler body 202, the capping assembly 210 also includes a biasing member 258 which urges sled 220 away from the tumbler body 202. To accomplish this, the biasing member 258 includes a rocking spring retainer or keeper member 260, and a compression oil spring 262. The retainer 260 has a rocker member 264 that rests upon the rocker pivot post 215, which projects from the tumbler stop wall 214. During assembly and disassembly, the spring 262 is secured to the sled 220 by the rocker arms 264 of the keeper 260.

Figure 11:
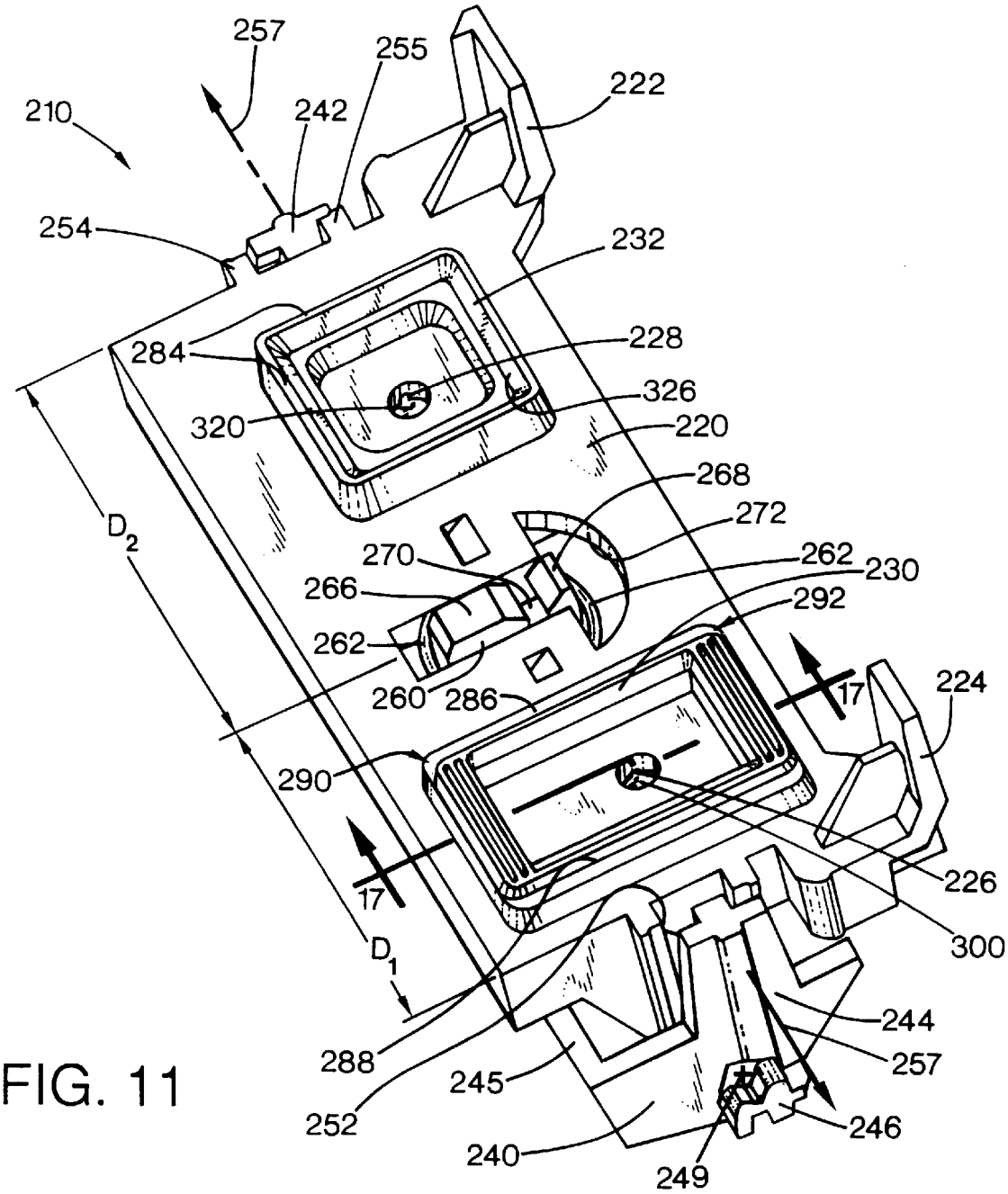
FIG. 11 is a perspective view of a cap sled and connecting link of the system of FIG. 9.
Figure 12:
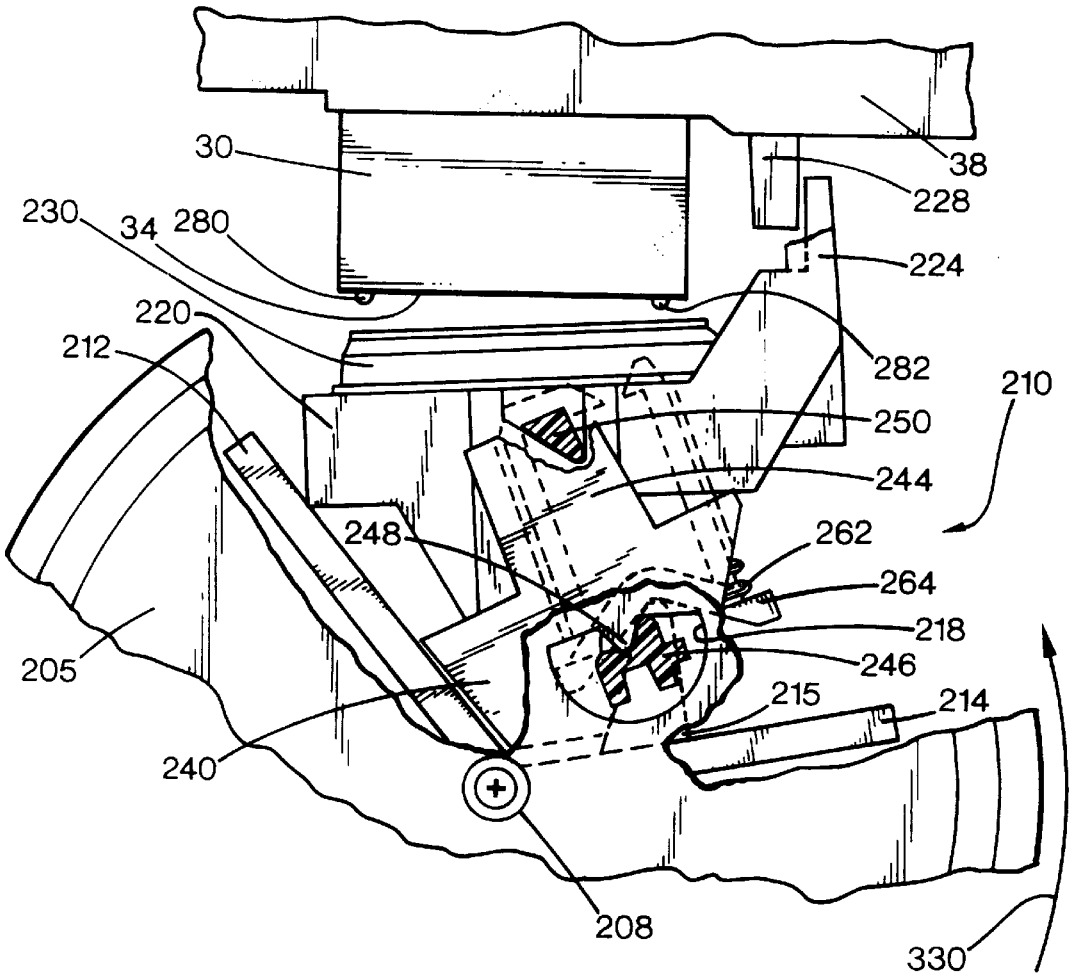
FIG. 12 is a fragmentary, side elevational, sectional view of the system of FIG. 9, shown prior to capping.

The keeper 260 has two projecting finger members 266 and 268, which both terminate in latches that grasp a pivot pin or post member 270 of the sled 220. The sled pivot post 270 is recessed within a roughly T-shaped slot 272 formed within the cap-supporting platform portion of sled 220. The T-shaped slot 272 is sized to slidably receive therethrough the tips of the retainer fingers 266, 268, for instance, as shown in FIG. 11. Preferably, the spring 262 is under a slight compression to bias sled 220 away from the tumbler stop wall 214, and toward the rest wall 212. This biasing is also assisted by the relative lateral positioning of the post 270 and the yoke-to-sled pivot axis 257. Preferably, the post 270 is located within sled 220 to be centered (front to back) on the black cap 230, whereas the link pivot axis 257 is positioned slightly off-center toward arms 222, 224 (such as about 2 mm off center in the illustrated embodiment).

To provide a greater upward sealing force of the cap 230 against the black pen face 34 than provided by the color cap 232 against the color pen face 36, the retainer 260 is mounted offset from the center line of the sled 220. That is, the T-shaped slot 272 and the pivot post 270 are mounted at a distance $D_1$ from the edge of the sled platform adjacent the black cap 230, and a distance $D_2$ from the opposite platform adjacent the color cap 232. For example, in the illustrated embodiment, the distance $D_1$ is approximately 23 mm, whereas $D_2$ is approximately 28 mm.

The spring 262 presses against the rocker arms 264 a lower surface of the sled 220, with the varying points of contact being shown in FIGS. 13C and 14C. In FIG. 13C, when at rest, the sled pivot post 270 has an angled bearing surface 274, which rests against the inner surface of keeper finger 266. In FIG. 14C, the sled pivot post 270 has an upright side 276, which rests against the inner surface of the other keeper finger 268. Note, that the first finger 266 is much wider than the second finger 268, which aids in biasing the sled 220 toward the rest position (FIG. 13C), while also providing substantially upright alignment for capping (FIG. 14C).

Moreover, the keeper finger 266 and 268 form a slot 277 therebetween, which, in cooperation with the sled T-shaped slot 272, allows the sled 220 to further compress spring 262 through downward force of the printheads 30, 32. This stressing of spring 262 provides more secure sealing of the printhead nozzle plates 34, 36. That is, while the upper portions of fingers 266 and 268 are shown as being flush with the upper cap-supporting surface of sled 220 in FIG. 14C, the upper surfaces of the fingers 266, 268 may extend above this surface due to compression of spring 262 if required for capping.

Figure 16:
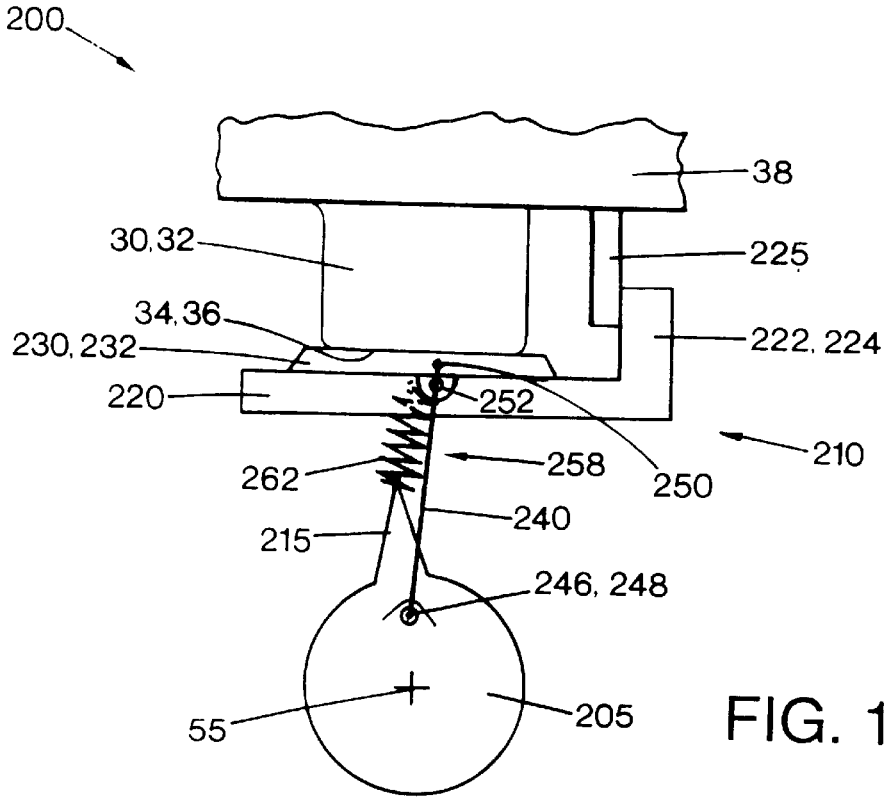

Note, that compression of spring 262 causes the wedge-shaped pivot hooks (see FIGS. 13B and 14B) to float upwardly in the sled pockets 252, allowing the sled 220 to move with respect to the yoke 240, as also indicated schematically in FIG. 16. This floating of hooks 250 allows for tilting of the sled 220, as indicated by arrow 278 in FIG. 9. In this tilting motion, the hooks 250 may dip to different depths within the pockets 252 of yoke ears 242, 244, for example, to accommodate for any variations in the sealing forces required for pens 30 and 32. Furthermore, the hooks 250 are undersized with respect to the width of pockets 252, as defined by the spacing of rails 254, 255, which allows for some skewing of the sled 220 with respect to yoke 240, as indicated by arrow 279 in FIG. 9.

Figure 15:
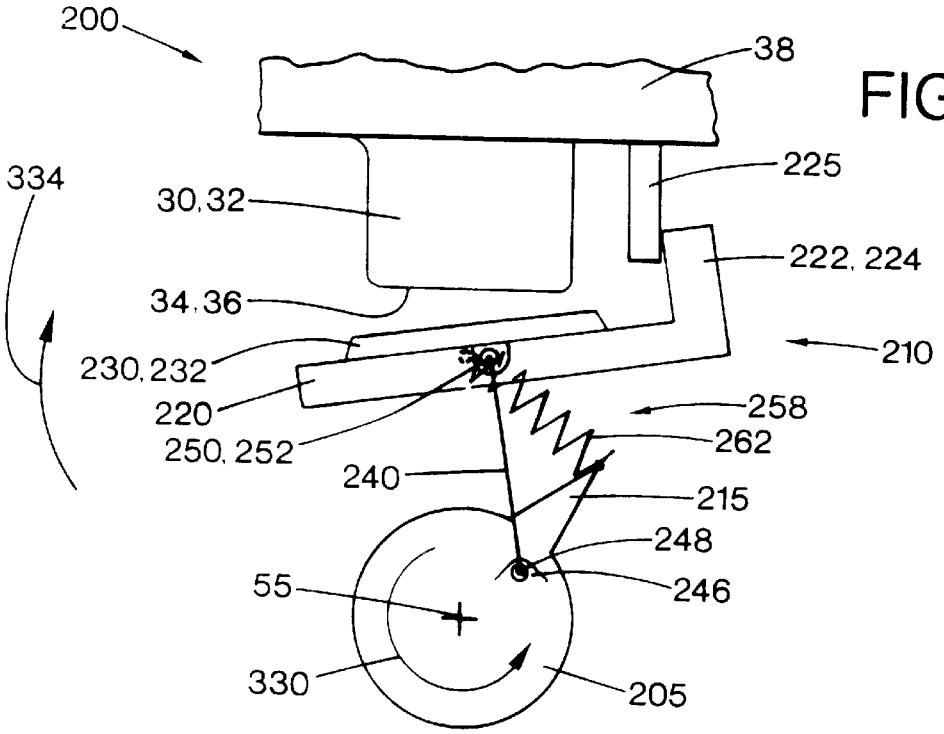
FIGS. 15 and 16 are schematic side elevational views illustrating the capping operation of the rotary service station embodiment of FIG. 9.

In operation, from the following discussion of the rotary capping system 200, a method of sealing inkjet printhead nozzles is also illustrated. Reference to the schematic drawings of FIGS. 15 and 16 is helpful to illustrate the relative forces and positions of the capping assembly 210 in the rest and capping positions, respectively. The printer 20 may include a conventional stepper motor, which is coupled to drive the service station about the first axis 55, via the drive gear 60 (FIGS. 1–4 illustrate the drive gear 60 as having gear teeth surrounding the tumbler rim 204). The tumbler body 202 is rotated in the direction indicated by the curved arrow 330 until the carriage engagement arms 222, 224 contact the carriage alignment member 225 (see FIGS. 12, 13A, 13C). Continued rotation of the tumbler body 202 in the direction indicated by arrow 330 causes the pivoting illustrated through a comparison of FIGS. 13A–13C with the respective FIGS. 14A–14C, as the capping assembly 210 transitions from a rest state to a sealing state. In FIGS. 13A–13C, the tumbler 202 is at a cap entry position, nominally defined here as a zero degree (0°) position, which also corresponds to a cap exit position for uncapping followed by other servicing (e.g. wiping or priming) or printing. In FIGS. 14A–14C, the tumbler 202 is at a fully capped, maximum bottomed out position, which is about 44° beyond the cap entry (0°) position.

FIGS. 13A and 14A illustrate the rotation of the yoke 240 with respect to the tumbler body 202. FIGS. 13B and 14B illustrate the rotation of the tumbler body 202, with respect to the yoke 240 and the sled 220. In FIG. 13B, while the tumbler body rotates in the direction indicated by arrow 330, the link 240 rotates around axis 249 in a direction indicated by arrow 332, and the sled 220 rotates upwardly around axis 257 in the direction indicated by the arrow 334 to rock into the capping position of FIG. 14B. FIG. 13C illustrates the rotation of the rocking spring keeper 260 with arrow 336.

As shown in FIGS. 14B and 14C, the respective black and color pens 30, 32 are capped, and spring 262 is compressed. The compression force supplied by spring 262 upwardly from the tumbler stop wall 214 forces the sled 220 and caps 230, 232 to press against the pen faces 34, 36. The gimbal mounting provided by the loose fit of the yoke wedge-shaped pivot hooks 250 within the sled pockets 252, as well as the gimbaling action provided by mounting sled 220 to the retainer 260, allows the sled 220 to tilt with respect to a plane defined by the pen faces 34, 36. This tilting ray compensate for irregularities on the printhead face, such as ink build up or the black pen encapsulant beads 280, 282, while maintaining a pressure tight seal adjacent the pen nozzles.

In the capping position shown in FIGS. 14A–14C, the spring force supplied by spring 262 maintains a controlled pressure against the pen faces, even when the printer unit 20 has been turned off. Positive energy provided by the stepper motor reversing the rotational direction of arrow 330 is required to disengage the capping assembly 210 from the pens 30, 32. When the arms 222, 224 are no longer contacted by the printhead carriage member 225, the slight at-rest compression of spring 262 biases sled 220 away from the tumbler stop wall 214, which serves to retract the capping assembly 210 from the capped position back to the rest position The noncentering feature of the keeper 260 also forces the sled 220 against the rest wall 212. Thus, this offcentering feature of biasing member 258 forces the cap sled into a rest position adjacent wall 212, allowing the capping assembly 210 to be rotated in the direction opposite arrow 330 without contacting the printheads 30, 32. This rest position or retracted state, allows the pens to freely travel over the service station 200 to the printzone 25.

Multi-Ridge Capping Assembly

Figure 17:
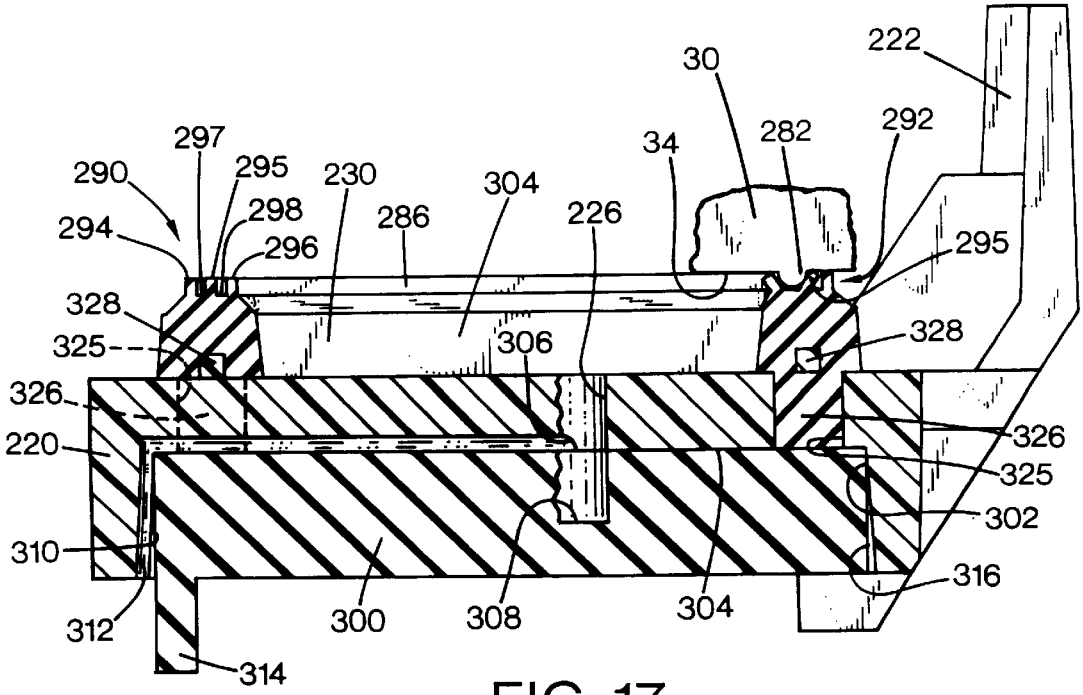
FIG. 17 is a side elevational sectional view of the multi-ridge cap taken along lines 17—17 of FIG. 11.
Figure 18:
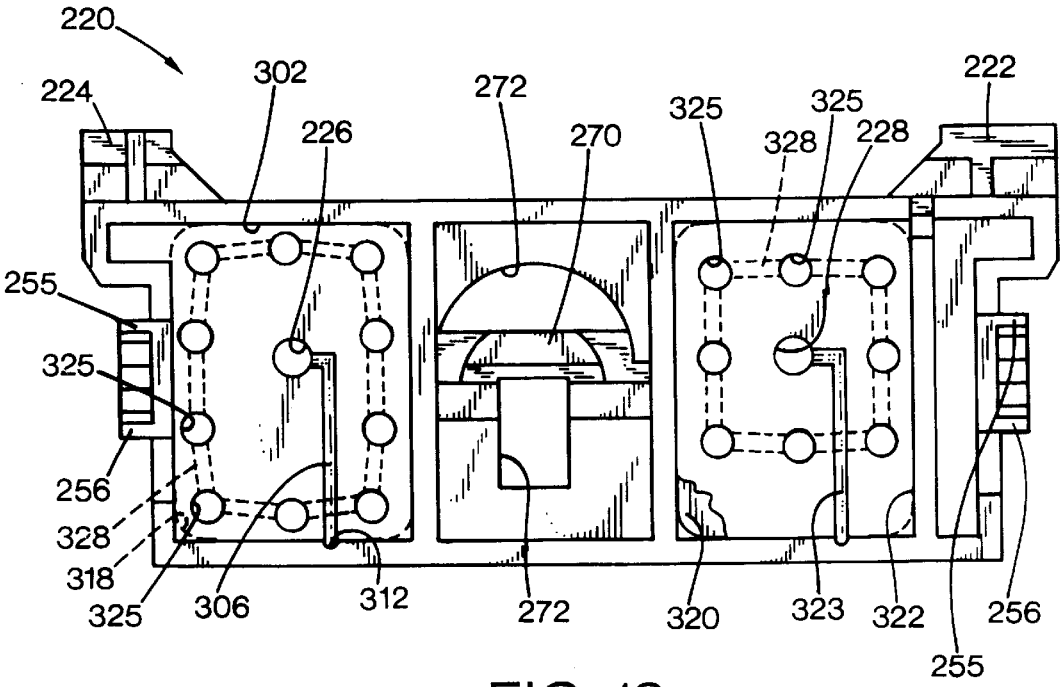
FIG. 18 is an enlarged bottom plan view of the cap sled of FIGS. 9–10 and FIGS. 12–13.

FIGS. 17 and 18 illustrate a preferred embodiment of a multi-ridge capping assembly 230 constructed in accordance with the present invention. To provide higher resolution hardcopy printed images, recent advances in printhead technology have focused on increasing the nozzle density, with levels now being on the order of 300 nozzles per printhead, aligned in two 150-nozzle linear arrays for the black pen 30. These increases in nozzle density, current limitations in printhead silicon size, pen-to-paper spacing considerations, and media handling constraints have all limited the amount of room remaining on the pen face for capping. While the printhead and flex circuit may be conventional in nature, the increased nozzle density requires optimization of cap performance, including sealing in often uneven sealing areas. For example, referring to FIG. 12, the printhead nozzle surface 34 is bounded on each end by two beads 280, 282 of an encapsulant material, such as an epoxy or plastic material, which covers the connection between a conventional flex circuit and the printhead housing the ink firing chambers and nozzles. The protective end beads 280, 282 occupy such a large portion of the overall printhead area, that providing a positive, substantially moisture impervious seal around the printhead nozzles is difficult using a conventional single sealing ridge or lip, such as lip 284 of the color cap 232 (FIG. 11).

However, to seal across the uneven of the protective end beads 280, 282, the black cap 230 preferably has a lip with at least a portion comprising adjacent plural or redundant contact regions. Preferably, each redundant contact region is capable of sealing over surface irregularities on the face plate by forming an air-tight seal in the flat areas adjacent the irregularities. In the illustrated embodiment, the two such redundant sealing portions of the lip are shown as multi-ridged capping zones 290 and 292, which seal the printhead adjacent the end beads 280 and 282, respectively. The multi-ridge cap areas 290, 292 may have adjacent plural contact regions illustrated as two or more substantially parallel ridges or crests, with the illustrated embodiment having three ridges 294, 295 and 296 separated by two troughs or valley portions 297, 298. Along the longitudinal lip region parallel to the linear nozzle arrays, the black cap 230 has single-ridged sealing surfaces 286, 288 (see FIG. 11).

The sealing ability of the multi-ridge cap area 292 is shown in FIG. 17, sealing pen face 34 over the end bead 282 by compressing the intermediate crest 295 more than crests 294 and 296 are compressed. These wide sealing regions 290, 292 may advantageously seal over ink residue or other debris accumulated on the pen face. Additionally, while the adjacent plural contact regions are illustrated as mutually parallel ribs, it is apparent that other geometric patterns may also be used, such as interlinking ovals, circles, or a labyrinth pattern, for instance.

The capping assembly 210 also includes a black pen sealing chamber vent cap or stopper 300, which sits within a recess 302 formed along the underside of the capping sled 220. Preferably, the vent cap 300 is of a Santoprene® rubber sold by Monsanto Company, Inc., or other ink-phyllic resilient compound structurally equivalent thereto, as known to those skilled in the arm Preferably, the cap sled 200 is of a polysulfone plastic or other structurally equivalent plastic known to those skilled in the art. When sealed against the printhead surface, the ridges 286, 288, 294–296 define a main sealing chamber or cavity 304, which is in fluid communication with the vent hole 226.

The vent cap recess 302 includes an upper surface 305 which has a pressure equalization groove or channel 306 formed therein to provide a pressure equalizing vent passageway from the main sealing chamber 304 to atmosphere when the vent stopper 300 is installed. To aid in pressure damping during capping, the stopper 300 also defines a damping chamber 308 therein which is in communication with the passageway formed by the pressure equalization channel 306. The pressure equalization channel 306 provides an escape passage way for air trapped between the printhead 34 and the cap 230 during capping. Also, when capped during extended periods of printer inactivity, the vent 306 advantageously maintains an equal pressure between the cap chamber 304 and the ambient conditions in the environment, even during changed in barometric pressure, temperature, and the like. Without such a vent, the air trapped within the main sealing chamber 304 could be forced into the printhead nozzles, causing depriming. Use of the vent passageway 306 advantageously prevents depriming.

The pressure equalization groove 306 continues along the upper surface 305 until intersecting a vertical surface 310 of recess 302. The pressure equalization channel continues through a groove 312 defined by wall 310. To assist in drawing ink through the pressure equalization channel 306, 312 the vent cap 300 includes a vent cap drain stick 314, also formed of the same materials as the main body of stopper 300.

Clogging of the vent channel 306 by ink accumulation is advantageously avoided by using a Santoprene® or other ink-phyllic compound for the vent stopper 300. In the areas where the stopper 300 meets the sled 220, small passageways are formed which pull any accumulated ink from the channel 306 through capillary action. Through capillary draw, the wicked ink fills the sharp corners and small spaces where the stopper 300 meets the sled 220, such as along the recess upper surface 305 and then along the side walls of the recess 302, such as at 316. Preferably, the stopper 300 has rounded corners 316, such as indicated by dashed lines 318 in FIG. 18.

As shown in FIG. 18, the capping assembly also includes a color vent stopper 320, which sits in a recess 322 beneath the color cap 232. The recess 322 also has a pressure equalization groove or channel 323 formed along the upper and vertical surfaces to allow pressure to escape from a main sealing chamber 326 (see FIG. 11) defined by the color pen 32 when sealed by cap 232. Venting through channel 323 allows pressure formed during capping to vent from the cap area to avoid depriming of pen 32. To avoid clogging of the pressure equalization channel 323, the capillary action interrelation of the color stopper 320 and recess 322 are the sane as described above for the black ink pen stopper 300 and recess 302. Preferably, the color stopper 320 also has a drain stick 324 (FIG. 9) adjacent the exit port of the equalization channel 323.

Preferably, the caps 230 and 232 are oncert molded to the sled 220. In the illustrated embodiment, the sled 220 has a plurality of oncert molding holes, such as holes 325, formed therethrough which are filled with a portion of the cap material in a plug form 326, as shown in FIG. 17. Preferably, the molding holes 325 are joined together along the upper cap-supporting surface of the sled 220 by a molding race 328, which aids in adhering the caps 230, 232 to the sled 220. It is believed that the present invention is the first use of oncert molding techniques in attaching pen caps to sleds, and it is particularly advantageous to maintain the close tolerances and sealing dimensions desired in providing a high quality printer 20.

Advantages of the Rotary Multi-Ridge Capping System

As a first advantage, an improved pen alignment and registration of the caps 230, 232 with the pens 30, 32 is realized due to the engagement of the arms 222, 224 with the printhead carriage structure 225. This method of aligning the caps with the pens avoids inadvertently covering the printhead nozzles with any portion of the cap lip or sealing ridges, which could otherwise allow leaking or drying of the ink within the pen, and/or result in clogging the nozzles.

Another advantage of the gimbaling action of sled 220, provided by the loose fitting alignment of the yoke 240 and sled 220, as well as that provided by the rocker 264 coupling sled 220 with the tumbler body 220, allows for gimbaling or tilting action of the sled 220 with respect to the tumbler body 202. Moreover, the loose fitting nature of these pivots renders them virtually immune to any ink contamination from pen leakage, which would otherwise bind the service station and prevent operation in a tight fitting service station system. This immunity to ink contamination is particularly important with respect to the newer pigment-based inks, which may increase friction on the sliding surfaces of various subsystems within the printer, a problem avoided by the rotary service station 200.

A further advantage of the capping system 210 is the ability to be positively locked in place when capped (FIGS. 14A–14Q without using friction along sliding surface, as required by many earlier capping systems. As described above, long sliding surfaces are prone to ink contamination, which may impede the seal, or cause excessive friction to impede capping. Another advantage of the present system 200 is the ability to securely cap the black printhead 30, including providing capping along the end cap beads of protective sealant 280, 282, through the use of the multi-ridged surfaces 290, 292 of the black cap 230.

An additional advantage of the capping assembly 210 is the use of a single coil spring 262 to apply differing forces to the pen faces. While an alternative manner of providing a pressure differential would be to make the black cap taller than the color cap, such a solution would pose a variety of practical problems including lack of the pen-to-paper (or print medium) spacing for optimum print quality. Instead, force differentials are advantageously applied to the pens by offsetting the location of the spring pivot post 270 with respect to the overall length of the sled platform 220. Thus, by virtue of the shorter distance $D_1$ of the retainer 260 to the black cap 230, a greater force is applied to the black pen face 34 during capping than that applied to the color face 36.

We claim:

1. A service station for servicing an inkjet printhead of an inkjet printing mechanism, with the printhead having a face plate defining a group of ink ejecting nozzles extending therethrough, and with the face plate having a surface irregularity located to one side of the nozzles, comprising:

a platform moveable into a capping position; and a printhead cap supported by the platform, the cap having a sealing lip which surrounds the nozzles and engages the face plate when the platform is in the capping position, with the lip having a redundant contact region located to said one side of the nozzles to seal over the surface irregularity of the printhead face plate.

2. A service station according to claim 1 wherein the sealing lip also has a single ridge portion.

3. A service station according to claim 2 wherein the redundant contact region comprises adjacent plural contact regions having a width less than a width of the single ridge portion of the sealing lip.

4. A service station according to claim 1 wherein the redundant contact region comprises at least two ridge portions separated by a trough portion defined by the lip.

5. A service station according to claim 1 wherein the ridge portions are substantially mutually parallel.

6. A service station according to claim 1 wherein the sealing lip has two opposing redundant contact regions coupled together by two opposing leg portions.

7. A service station according to claim 6 wherein the leg portions each comprise a single ridge portion.

8. A service station according to claim 7 wherein each redundant contact region comprises at least two ridge portions.

9. A service station according to claim 1 wherein:

a sealing cavity is formed between the cap and the printhead when in the capping position;

the platform has opposing first and second surfaces, with the first surface supporting the cap, and the second surface defining a stopper recess and a vent path, the platform also defining a passageway coupling the sealing cavity with the vent path; and the service station further includes a vent stopper of a resilient material received within the platform stopper recess to form a vent passageway coupling the sealing cavity to atmosphere.

10. A service station according to claim 1 wherein the vent stopper and the platform stopper recess cooperate to define a capillary passageway therebetween that draws any accumulated excess ink through the capillary passageway using capillary action.

11. A service station according to claim 1 wherein:

the vent stopper and the platform stopper recess cooperate to define an outlet port of the vent passageway; and the vent stopper includes a drip finger extending beyond the platform second surface adjacent the vent passageway outlet port.

12. A service station according to claim 1 wherein:

the surface irregularity comprises an elongate encapsulant bead member; and the redundant contact region comprises plural elongate ridge portions separated by a trough portion defined by the lip, with the encapsulant bead member being seated in the trough when the platform is in the capping position.

13. A service station according to claim 1 wherein the redundant contact region surrounds the surface irregularity of the printhead face plate.

14. An inkjet printing mechanism, comprising:

an inkjet printhead having a face plate which defines a group of ink ejecting nozzles extending therethrough, with the face plate having a surface irregularity located to one side of the nozzles; and a service station having a platform moveable into a capping position, and a printhead cap supported by the platform;

wherein the cap has a sealing lip which surrounds the nozzles and engages the face plate when the platform is in the capping position, with the lip having a redundant contact region located to said one side of the nozzles to seal over the surface irregularity of the printhead face plate.

15. An inkjet printing mechanism according to claim 14 wherein the sealing lip also has a single ridge portion.

16. An inkjet printing mechanism according to claim 15 wherein the redundant contact region comprises adjacent plural contact regions having a width less than a width of the single ridge portion of the sealing lip.

17. An inkjet printing mechanism according to claim 14 wherein the redundant contact region comprises at least two ridge portions separated by a trough portion defined by the lip.

18. An inkjet printing mechanism according to claim 17 wherein the ridge portions are substantially mutually parallel.

19. An inkjet printing mechanism according to claim 14 wherein the sealing lip has two opposing redundant contact regions coupled together by two opposing leg portions.

20. An inkjet printing mechanism according to claim 19 wherein the leg portions each comprise a single ridge portion.

21. An inkjet printing mechanism according to claim 20 wherein each redundant contact region comprises at least two ridge portions.

22. An inkjet printing mechanism according to claim 14 wherein:

a sealing cavity is formed between the cap and the printhead when in the capping position;

the platform has opposing first and second surfaces, with the first surface supporting the cap, and the second surface defining stopper recess and a vent path, the platform also defining a passageway coupling the sealing cavity with the vent path; and the service station further includes a vent stopper of a resilient material received within the platform stopper recess to form a vent passageway coupling the sealing cavity to atmosphere.

23. An inkjet printing mechanism according to claim 22 wherein the vent stopper and the platform stopper recess cooperate to define a capillary passageway therebetween that draws any accumulated excess ink through the capillary passageway using capillary action.

24. An inkjet printing mechanism according to claim 22 wherein:

the vent stopper and the platform stopper recess cooperate to define an outlet port of the vent passageway; and the vent stopper includes a drip finger extending beyond the platform second surface adjacent the vent passageway outlet port.

25. An inkjet printing mechanism according to claim 14 wherein:

the surface irregularity of the printhead face plate comprises an elongate encapsulant bead member; and the redundant contact region comprises plural elongate ridge portions separated by a trough portion defined by the lip, with the encapsulant bead member being seated in the when the platform is in the capping position.

26. An inkjet printing mechanism according to claim 14 wherein the redundant contact region surrounds the surface irregularity of the printhead face plate.

* * * * *

UNITED STATES PATENT AND TRADEMARK OFFICE

CERTIFICATE OF CORRECTION

PATENT NO. : 6,209,983 B1
DATED : April 3, 2001
INVENTOR(S) : Osborne et al.

It is certified that error appears in the above-identified patent and that said Letters Patent is hereby corrected as shown below:

Column 5,
Line 28, delete “environment” and insert therefor -- environment. --.

Column 6,
Line 10, delete “30.” and insert therefor -- 30, --.

Column 13,
Line 36, delete “ray” and insert therefor -- may --.
Line 53, delete “position” and insert therefor -- position. --.

Column 16,
Line 23, delete “14A-14Q” and insert therefor -- 14A-14C) --.

Column 17,
Line 24, delete “claim 1” and insert therefor -- claim 9 --.
Line 29, delete “claim 1” and insert therefor -- claim 9 --.

Signed and Sealed this

Tenth Day of September, 2002

*Attest:*

*Attesting Officer*

JAMES E. ROGAN
*Director of the United States Patent and Trademark Office*